United States Patent [19]

Honaker

[11] 4,095,777

[45] Jun. 20, 1978

[54] COMBUSTION CHAMBER WITH SLAG DAM AND DRAIN TROUGH

[75] Inventor: Donald E. Honaker, Ballwin, Mo.

[73] Assignee: Monsanto, St. Louis, Mo.

[21] Appl. No.: 741,826

[22] Filed: Nov. 15, 1976

[51] Int. Cl.[2] ..... C21B 7/12

[52] U.S. Cl. ..... 266/45; 266/271

[58] Field of Search ..... 266/45, 271; 431/121; 432/2, 67, 70, 71, 72

[56] References Cited

U.S. PATENT DOCUMENTS

| | | | |
|---|---|---|---|
| 3,110,272 | 11/1963 | Miller | 431/121 X |
| 3,521,869 | 7/1970 | Rudin et al. | 432/67 X |

*Primary Examiner*—Roy Lake
*Assistant Examiner*—Paul A. Bell
*Attorney, Agent, or Firm*—Arthur E. Hoffman

[57] ABSTRACT

Removal of molten slag from combustion chambers for combustion of combustible gases containing entrained slag-forming particulates, is frequently a problem since the slag tends to solidify in the tap-hole resulting in bridging and eventual pluggage of the tap-hole. This invention eliminates this problem by providing a dam around the periphery of the tap-hole of sufficient height to maintain a pool of molten slag on the inclined bottom of the combustion chamber to a depth whereby said slag pool is an effective heat sink to maintain the molten slag in flowable condition, and by providing in the dam at least one inclined drain trough which over-hangs the tap-hole a sufficient distance to minimize contact of draining slag with the walls of the tap-hole.

4 Claims, 6 Drawing Figures

COMBUSTION CHAMBER WITH SLAG DAM AND DRAIN TROUGH

FIELD OF THE INVENTION

This invention relates to an improved method and combustion chamber for combustion of combustible gases which contain entrained slag-forming particulates. More particularly it relates to providing within such combustion chamber a slag dam and drain trough in conjunction with a slag tap-hold such that pluggage of the tap-hole is avoided.

BACKGROUND OF THE INVENTION

Slagging is a problem frequently encountered in combustion chambers, particularly those used for the combustion of combustible gases containing entrained slag-forming particulates, such as for example, the afterburners employed in incineration plants or pyrolysis plants to complete the combustion of gaseous carbonaceous materials. Much of the particulate slag forming material is trapped in the combustion chamber as a molten slag. Tap-holes are provided in the combustion chamber for removing the molten slag. Horizontally disposed, frequently cylindrical, combustion chambers are normally disposed such that the bottom is slightly inclined and a tap-hole is provided in the bottom at the lowest end.

Frequently, highly viscous molten slags do not drain properly out of the combustion chamber through the tap-hole because without special precautions the molten slag drains as a relatively slow-moving thin film of molten slag over a wide path along or around the periphery of the tap-hole. Even a slight cooling as the thin slag film enters the tap-hole increases the viscosity sufficiently to start slag buildup on the wall of the tap-hole which in a short time bridges across the tap-hole opening, resulting in pluggage and inability to remove the molten slag in the combustion chamber, and necessitating a costly shut-down to chip away the solidified slag from not only the tap-hole but inside the combustion chamber where the slag has backed up.

SUMMARY OF THE INVENTION

It is an object of this invention to provide an improved combustion chamber for combustion of a combustible gas containing entrained slag-forming particulates.

A further object is the provision of a combustion chamber having a slag tap-hole disposed in the bottom thereof with means for preventing pluggage of the tap-hole with slag.

A further object is the provision of a method for draining molten slag from a combustion chamber without pluggage of the tap-hole with slag.

These and other objects are attained by a refractory lined combustion chamber comprising an inclined bottom, a dirty gas inlet, at least one burner, an outlet for the gaseous combustion products, a slag tap-hole in said inclined bottom proximate the lower end thereof, a dam with said combustion chamber around the periphery of said slag tap-hole having at least one inclined drain trough disposed in said dam at sufficient height such that a pool of molten slag is formed during operation to a depth whereby said pool of molten slag is an effective heat sink to maintain the molten slag in a flowable condition, said inclined drain trough over-hanging said slag tap-hole a sufficient distance to minimize contact of draining slag with the walls of said tap-hole.

Due to the elevated temperatures within the combustion chamber during operation, all interior surfaces exposed to the combustion and the molten slag are preferably refractory lined.

The function of the dam around the slag tap-hole is to create a pool of molten slag in the bottom of the combustion chamber. This pool of molten slag, when of sufficient depth, serves as a heat sink to prevent cooling of the slag as it drains to the tap-hole and thus maintains the viscosity of the molten slag as low as possible.

The slag tap-hole may be of any configuration, e.g., circular, elliptical, square, rectangular, etc., capable of handling the quantity of slag to be discharged from the combustion chamber. The dam should preferably conform to the configuration of the tap-hole, although this is only necessary at these points where an inclined drain trough is located. Circular or elliptical dams offer the greatest strength and can be used with some saving in the quantity of material of construction required to withstand the pressures on the dam from the pool of molten slag.

The inclined drain trough is disposed within the dam with its higher end at the outer wall of the dam at a height such that the desired depth of the pool of molten slag is created before slag drainage down the trough can begin. The function of the inclined drain trough is to define a short, narrow path for slag drainage so that the draining stream of molten slag is flowing at a high rate and is maintained as a thin shallow stream for as short a time as possible. The lower end of the drain trough overhangs the slag tap-hole by sufficient distance that the draining molten slag drips down through the tap-hole some distance away from the walls of the tap-hole.

Thus, time and distance the molten slag must flow as a thin stream or film (the condition in which it is susceptible to sharp increases in viscosity with only slight temperature drop) is held to a minimum. Moreover, the molten slag is drained into the tap-hole in a manner which minimizes or avoids its contacting the walls of the tap-hole so that pluggage of the tap-hole is avoided.

The combustion chamber normally is equipped with a burner for the combustion of auxiliary fuel, at least during start-up, and often after operating equilibrium is attained so as to obtain a desired operating temperature in the event the BTO value of the combustible gas is insufficient. Advantageously, the burner is disposed at the end of the combustion chamber where its inclined bottom is at the lowest elevation and is disposed such that its flame is directed downwardly toward the tap-hole and the inclined drain trough. In serious slag plugging situations, another burner may, optionally, be disposed in the slag chute beneath the tap-hole such that its flame is directed upwardly toward the slag-hole and the inclined drain trough, though normally this second burner will not be required.

The drainage channel of the inclined drain trough may be of many configurations as will be apparent to those skilled in the art, keeping in mind the requirement that the flow rate of the molten slag must be rapid enough that the hot molten slag does not cool prior to dropping out of the drainage channel into the tap-hole to the extent that it becomes viscous enough to cling to the lower end of the trough and start a build up of solidified slag which eventually will lead to pluggage.

Thus, if a flat basin drainage channel is used it should be sized according to the amount of slag to be drained per unit time. Preferably, however, a generally "V" shaped drainage channel is used, e.g., see FIGS. 3 and 6.

A tapered drainage channel which is wider where the molten slag is received and narrower where it is discharged is preferred.

One or more inclined drain troughs are used, the number and/or their size depending upon the size of the combustion chamber and the quantity of slag which must be handled per unit of time; e.g., pounds per hour or kilograms per hour.

The location of the inclined drain troughs in the dam will be governed by the configuration of the combustion chamber, particularly the configuration of its inclined bottom. In a horizontally disposed cylindrical combustion chamber with one end slightly elevated and the slag tap-hole close to the lower end, one inclined drain trough will normally suffice, preferably disposed in the dam directly below the longitudinal axis of the combustion chamber on the side nearest to the elevated end of the kiln. If desired, however, a singly, or a plurality of, drain trough(s) can be used at any location in the dam where effective drainage can be obtained, as will be apparent to those skilled in the art.

With flat bottomed combustion chambers the number of inclined drain troughs, their size and their location in the dam should be selected on the basis of good engineering practices with respect to drainage of viscous molten slag from flat inclined surfaces, as is within the skills of the art.

The dam should be of sufficient height to provide a pool of molten slag of desired depth. Pools of from about 2 to 5 inches in depth are preferred. The inclined drain trough is installed in the dam with the elevated slag receiving end at sufficient height to maintain the pool of molten slag at the desired depth. Due to the high viscosity of the slag the base of the drainage channel of the trough will be somewhat lower than the level of the pool of slag. Depending upon the profile of the drainage channel and its cross-sectional area receiving the molten slag, the base of the drainage channel may be, e.g., anywhere from about 0.5 to 1.5 inches below the level of the slag pool.

The inclined drain trough should be disposed at an angle sufficient that the molten slag draining into the tap-hole does not run up the underside of the trough where it may tend to solidify and result in slag build-up and eventual plugging. A suitable angle would be about 20° to 45°, and preferably 25° to 35°, from the horizontal. It should preferably over-hang the slag-hole such that the base of the drainage channel at the discharge end is at least 2, and more preferably at least 4, inches from the nearest wall of the tap-hole.

DESCRIPTION OF THE PREFERRED EMBODIMENTS

Figure 1:
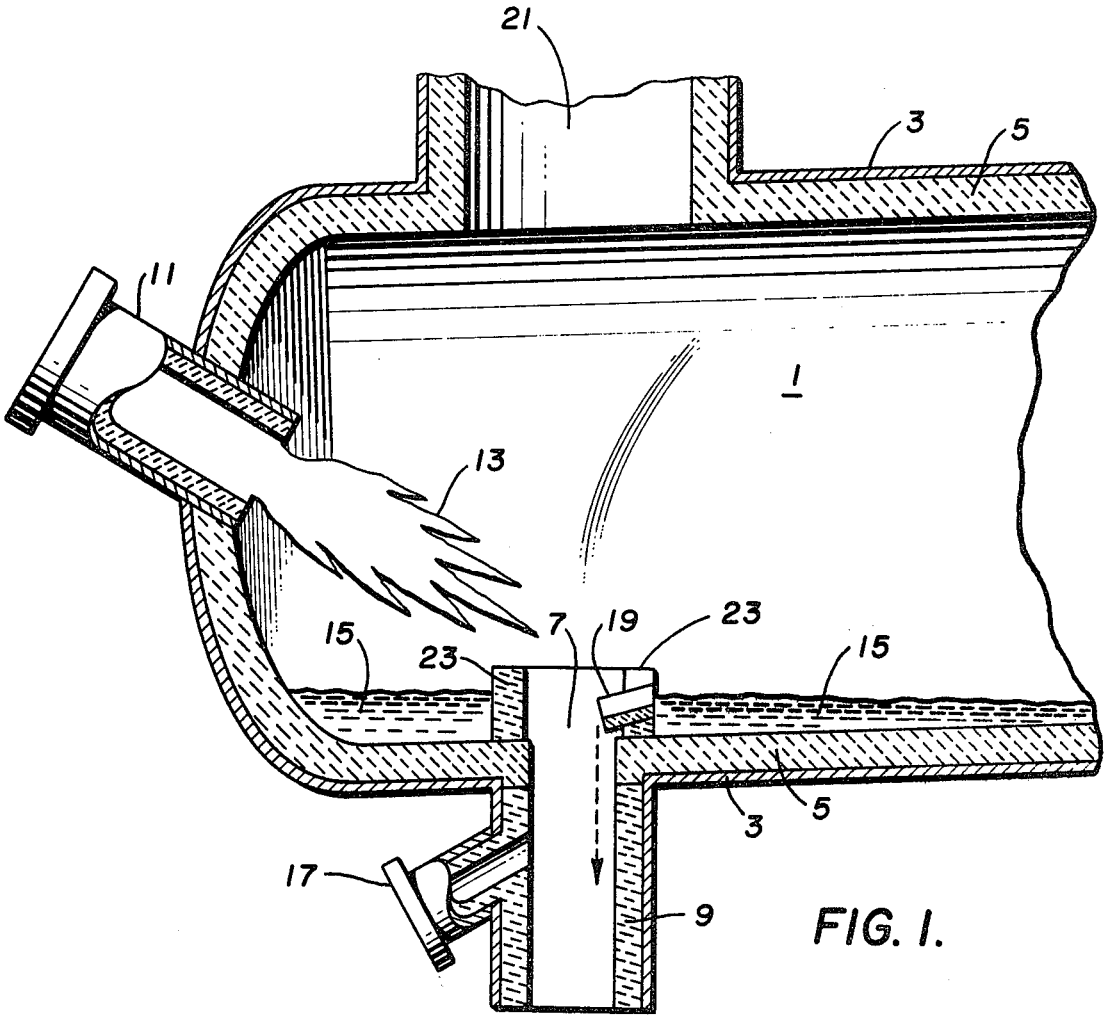
FIG. 1 is a side cross-sectional cut-away view of one end of a combustion chamber which is a preferred embodiment of this invention.

FIG. 1 shows one end of a horizontally disposed cylindrical combustion chamber 1 having a steel shell 3 lined with refractory 5. The combustion chamber is slightly inclined such that slag tap-hole 7 is near the lower end. The combustion chamber is further provided with a refractory lined slag chute 9 which normally extends into a quench tank (not shown) beneath the liquid level therein which serves as a seal against uncontrolled leakage of air into the combustion chamber. Burner 11, which operates from auxiliary fuels during start-up and optionally after equilibrium conditions are attained, is disposed such that its flame 13 directed toward tap-hole 7 and the pool of molten slag 15. If desired a second burner 17, which also operates on auxiliary fuel may be mounted in slag chute 9 such that its flame is directed towards the tap-hole 7 where the molten slag is draining from inclined drain trough 19.

The combustion chamber is also provided with inlet 21 for the combustible gas laden with entrained slag-forming particulate material, an outlet (not shown) for the gaseous combustion products, and suitable nozzles (not shown) for the admission of the desired amount of combustion air. Since it is only the slag tap-hole area which is of concern to this invention, the other end of the combustion chamber is not shown. In fact, the entire combustion chamber except for the tap-hole area can be designed in accordance with any criteria or objectives the practitioner may select without departing from this invention.

Inclined drain trough 19 is disposed in dam 23 such that the base of the drainage channel of trough 19 at the slag receiving end is slightly below the level of the pool of molten slag 15 on the side of the tap-hole 7 closest to the elevated end of the combustion chamber 1 and preferably centrally disposed directly underneath the longitudinal axis of the cylindrical combustion chamber.

In the embodiment shown, a dam approximately 15 to 26 inches high surrounding a rectangular tap-hole about 3 to 4 feet wide along the longitudinal axis of the combustion chamber and about 5 to 7 feet wide across the transverse axis may suitably be used in a combustion chamber of about 8 to 20 feet internal diameter by 25 to 75 feet long, handling 300 to 2500 pounds of molten slag per hour at an operating temperature of from about 2300° to 2800° F. The inclined drain trough may be disposed such that the base of its drainage channel at the slag receiving end is from about 5 to 16 inches from the bottom of the combustion chamber, providing a slag pool depth of about 6 to 18 inches, although shallower or deeper slag pools may be used if desired.

Figure 2:
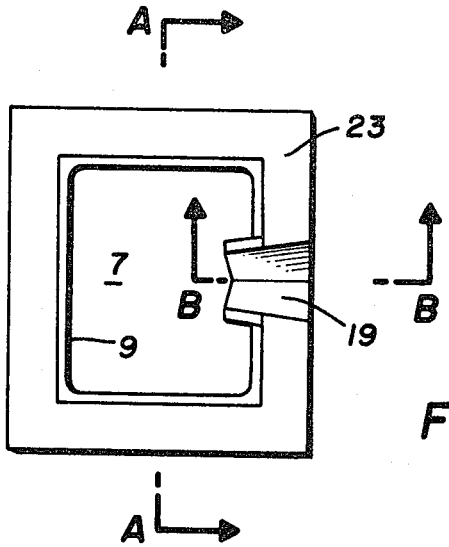
FIG. 2 is a plan view of the slag tap-hole, dam and inclined drain trough of FIG. 1.
Figure 3:
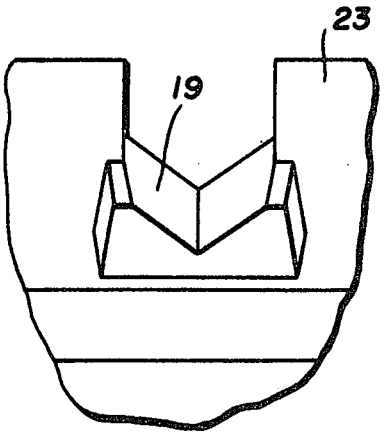
FIG. 3 is a front view of the section of the dam in which the inclined drain trough is disposed, taken along section A—A of FIG. 2.
Figure 4:
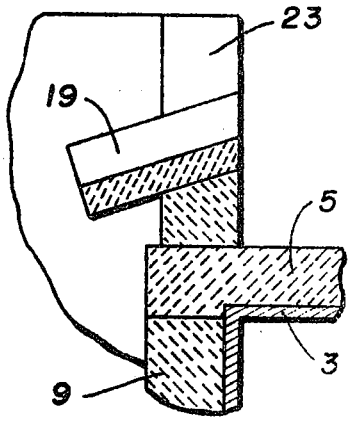
FIG. 4 is a side cross-sectional view of the tap-hole, dam and inclined drain trough, taken along section B—B of FIG. 2.

FIGS. 2 through 4 show details of one embodiment of the slag tap-hole 7, dam 23 and inclined drain trough design. Referring to FIG. 3, it is not required that dam 23 extend vertically from the drain trough 19 as shown, advantageously the dam may taper on each side of trough 19 upwardly and away from the trough.

Figure 5:
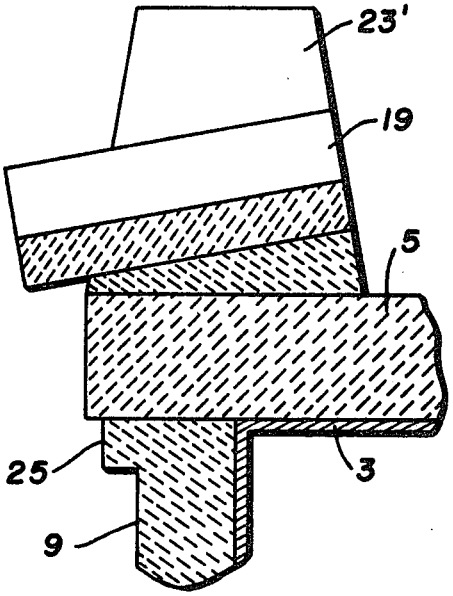
FIG. 5 is a modified equivalent of FIG. 4, showing a dam configuration which forms a preferred embodiment of this invention.

FIG. 5 shows a preferred embodiment in which dam 23′ is tapered so that it is wider at its base than at its top. Such design provides good strength and improved distribution of the force of the slag pool retained behind the dam. FIG. 5 also shows a modification of slag chute 9 whereby the refractory wall of the slag chute is provided with a lip 25 which provides adequate support to the combustion chamber refractory 5 and dam 23', yet allows cutting the refractory walls of slag chute 9 back so as to reduce the likelihood of any draining slag becoming deposited on the walls of the slag chute so as to eventually result in plugging.

Figure 6:
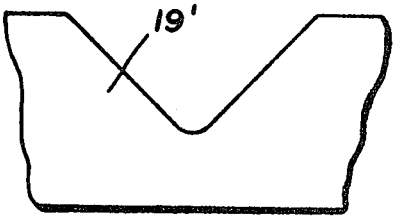
FIG. 6 is an end profile of an inclined drain trough, showing a drainage channel configuration which forms a preferred embodiment of this invention.

FIG. 6 shows a particularly preferred profile of the draingage channel of inclined drain trough 19', wherein the base of the "V" shaped channel is rounded. Alternatively the base may be flat, if desired.

The foregoing description of the several embodiments of this invention as described above and in the drawings is not intended as limiting of this invention. As will be apparent to those skilled in the art the inventive concept set forth herein can find many applications, and many variations on and modifications to the embodiments described herein may be made without departing from the spirit and scope of this invention.

What is claimed is:

1. A method for draining hot molten slag from a combustion chamber which comprises providing at least one inclined drainage trough within said combustion chamber, forming a pool of molten slag of sufficient depth to serve as a heat sink maintaining the molten slag in a flowable condition, drawing molten slag from said pool in at least one laterally thin stream flowing at a rate such that there is no substantial increase in viscosity of the molten slag after it leaves the pool, and discharging said thin stream(s) of molten slag from said combustion chamber through a slag tap-hole with essentially no contact of molten slag with any surface of sufficiently lower temperature than that of the molten slag to cause solidification of said slag on or around said tap-hole.

2. In a refractory lined combustion chamber for combustion of a combustible gas containing entrained slag-forming particulates, said combustion chamber comprising an inclined bottom, a dirty gas inlet, an outlet for the gaseous combustion products, and a slag tap-hole in said inclined bottom proximate the lower end thereof, the improvement which comprises disposing a vertical dam within said combustion chamber around the periphery of said slag tap-hole with at least one inclined drain trough disposed in said dam at sufficient height such that a pool of molten slag is formed during operation to a depth whereby said pool of molten slag is an effective heat sink to maintain the molten slag in a flowable condition, said inclined drain trough over-hanging said slag tap-hole a sufficient distance to minimize contact of draining slag with the walls of said tap-hole.

3. A refractory lined combustion chamber as in claim 2 wherein said inclined drain trough has a generally "V" shaped drainage channel.

4. A refractory lined combustion chamber as in claim 2 wherein the combustion chamber is a substantially horizontally disposed cylindrical combustion chamber having a burner at one end, a slag tap-hole proximate said burner end, a vertical dam within said combustion chamber surrounding the periphery of said tap-hole, and an inclined drain trough disposed in said dam on the side of the tap-hole remote from said burner end and directly beneath the longitudinal axis of the combustion chamber.

* * * * *